US009682841B2

(12) United States Patent
Tsunoda

(10) Patent No.: US 9,682,841 B2
(45) Date of Patent: Jun. 20, 2017

(54) SHEET FOLDING APPARATUS AND IMAGE FORMING SYSTEM

(71) Applicant: KONICA MINOLTA, INC., Chiyoda-ku, Tokyo (JP)

(72) Inventor: Akira Tsunoda, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 15 days.

(21) Appl. No.: 14/473,426

(22) Filed: Aug. 29, 2014

(65) Prior Publication Data

US 2015/0065327 A1 Mar. 5, 2015

(30) Foreign Application Priority Data

Sep. 2, 2013 (JP) ..... 2013-180846

(51) Int. Cl.
*B65H 37/06* (2006.01)
*B65H 45/18* (2006.01)

(52) U.S. Cl.
CPC ..... *B65H 45/18* (2013.01); *B65H 2801/27* (2013.01)

(58) Field of Classification Search
CPC ..... B65H 37/06; B65H 45/18
USPC ..... 270/32, 39.08; 493/444, 445
See application file for complete search history.

(56) References Cited

U.S. PATENT DOCUMENTS 4,109,902 A * 8/1978 Barrer ..... B65H 45/20 493/444
6,746,390 B2 * 6/2004 Tamura ..... B65H 37/04 270/58.09
7,111,837 B2 * 9/2006 Itou ..... B42C 1/125 270/32
7,261,288 B2 * 8/2007 Hosoya ..... B42C 1/12 270/32
7,850,155 B2 * 12/2010 Mizubata ..... B65H 45/14 270/20.1
8,162,303 B2 * 4/2012 Fukatsu ..... B65H 45/18 270/32

(Continued)

FOREIGN PATENT DOCUMENTS

JP 2011184190 A 9/2011
JP 2013082512 A 5/2013
JP 2013116789 A 6/2013

OTHER PUBLICATIONS

Japanese Office Action (and English translation thereof) dated Aug. 25, 2015, issued in counterpart Japanese Application No. 2013-180846.

*Primary Examiner* — Patrick Mackey
(74) *Attorney, Agent, or Firm* — Holtz, Holtz & Volek PC

(57) ABSTRACT

Disclosed is a sheet folding apparatus which performs a first folding and a second folding on one or a plurality of sheets including a first roller which is one of rollers that form a first nip which performs the first folding, a second roller which forms the first nip with the first roller, a third roller which forms a second nip with the second roller which performs the second folding, a roller drive unit which operates the first, second and third rollers, a first pushing member which pushes a sheet in the first nip, a first push drive unit which operates the first pushing member, a second pushing member which pushes the sheet in the second nip, a second push drive unit which operates the second pushing member, and a control unit which controls the roller driver unit, the first push drive unit and the second push drive unit.

16 Claims, 6 Drawing Sheets

(56) References Cited

U.S. PATENT DOCUMENTS

| | | | | |
|---|---|---|---|---|
| 8,276,899 | B2 * | 10/2012 | Kimata | B65H 29/14 270/32 |
| 8,336,869 | B2 | 12/2012 | Fukatsu et al. | |
| 8,505,899 | B2 * | 8/2013 | Kawatsu | B65H 45/18 270/32 |
| 8,573,580 | B2 * | 11/2013 | Izumichi | B65H 45/142 270/20.1 |
| 8,851,464 | B2 * | 10/2014 | Shimizu | G03G 15/6544 270/32 |
| 8,900,110 | B2 * | 12/2014 | Jung | B65H 45/18 493/360 |

* cited by examiner

SHEET FOLDING APPARATUS AND IMAGE FORMING SYSTEM

BACKGROUND OF THE INVENTION

1. Field of the Invention

The present invention relates to a sheet folding apparatus and an image forming system.

2. Description of Related Art

There has been developed a sheet processing apparatus provided with a sheet folding apparatus which folds sheets in three after the sheets on which printing is done are output from an image forming apparatus according to a job executed by the image forming apparatus such as a printer. Sheets are to be folded in three in a case where documents (sheets) which are larger than envelopes need to be folded to be enclosed in the envelopes to mail them out, for example.

Conventionally, as described in JP 2013-116789, a sheet folding apparatus provided with a pair of rollers which rotate and which are in contact with each other and a knife-shaped pushing unit which reciprocates linearly moving forward in its tip direction and return has been used. A nip formed of the pair of rollers is arranged in the tip direction of the pushing member, and the sheet conveyance mechanism is configured so as to convey the sheet between the tip of the pushing member and the nip. Then, the pushing member is moved toward the sheet which is conveyed in between the tip of the pushing member and the nip so that the pushing member abuts the sheet. Thereafter, by pushing the sheet in the nip which is formed of the pair of rollers, the sheet is pulled in to the pair of rollers and folded. In order to fold the sheet at a predetermined position, the pushing operation timing of the pushing member is controlled so as to be coordinated with the conveyance position of the sheet.

Folding needs to be performed at two positions in a sheet in order to fold the sheet in three, and the folding-in-three process is carried out by sequentially performing the first folding at the first position and the second folding at the second position. Therefore, the first nip for performing the first folding, the first pushing member which pushes a sheet in the first nip, the second nip which performs the second folding and the second pushing member which pushes the sheet in the second nip are provided.

With respect to the sheet folding apparatus disclosed in JP 2013-116789, total of three rollers which are the first roller which is one of the rollers forming the first nip, the second roller which forms the first nip with the first roller and the third roller which forms the second nip with the second roller are provided. Here, with any one of the first roller, the second roller and the third roller rotating by the drive unit, the other rollers rotate following the driven roller.

Further, with respect to the sheet folding apparatus disclose in JP 2013-116789, a sheet bundle is stopped and held at a stacker just before the first folding operation, the first folding position is controlled by controlling the position of the stacker in the sheet conveying direction, the first folding operation is performed by making the first pushing member move forward to the first nip where two rollers are rotating, and the second folding member is made to move forward to the second nip after a predetermined time elapsed from the time when the first pushing member started its forward movement. The second folding position is controlled by the predetermined time.

In the above described conventional sheet folding apparatus which performs the folding-in-three process, a sheet is pushed in to the second nip by the second pushing member while the sheet is being conveyed during the time from when the first folding operation ends until the second folding operation in a state where the rollers are rotating.

However, in such operation of the second folding where the sheet is pushed by the pushing member while the sheet being conveyed, since the tip of the pushing member moves closer to the sheet and comes in contact with the sheet surface which is moving in the sheet conveyance direction that is approximately orthogonal to the forward moving direction of the pushing member, the pushing member slips on the sheet and it is difficult to assure the accurate folding position even if the moving speed of the pushing member is made faster than the sheet conveyance speed.

SUMMARY OF THE INVENTION

The present invention is made in view of the above problem in a conventional technique, and an object of the present invention is to improve accuracy of the second folding position in a sheet folding apparatus which performs the first folding and the second folding after the first folding on one sheet or a plurality of pages of sheets.

In order to realize at least one of the above objects, a sheet folding apparatus which performs a first folding and a second folding after the first folding on one sheet or a plurality of pages of sheets reflecting one aspect of the present invention includes a first roller which is one of rollers that form a first nip which performs the first folding, a second roller which, with the first roller, forms the first nip, a third roller which, with the second roller, forms a second nip which performs the second folding, a roller drive unit which operates the first roller, the second roller and the third roller, a first pushing member which pushes a sheet in the first nip, a first push drive unit which operates the first pushing member, a second pushing member which pushes the sheet in the second nip, a second push drive unit which operates the second pushing member and a control unit which controls the roller driver unit, the first push drive unit and the second push drive unit, and the control unit executes a first folding control to perform the first folding by pushing the sheet in the first nip by moving the first pushing member forward to the first nip and moving the first pushing member backward from the first nip in a state where the first roller, the second roller and the third roller are rotating, and a second folding control with pause to perform the second folding by conveying the sheet for a predetermined amount while maintaining rotation of the first roller, the second roller and the third roller started in the first folding control, then, stopping the rotation of the first roller, the second roller and the third roller and pushing the sheet in the second nip by moving the second pushing member forward to the second nip, thereafter, moving the second pushing member backward from the second nip and reactivating the rotation of the first roller, the second roller and the third roller at a certain timing between start of the forward movement of the second pushing member and end of the backward movement of the second pushing member.

Preferably, the control unit changes the reactivation timing in the second folding control with pause according to the number of sheets.

Preferably, the control unit sets the reactivation timing in the second folding control with pause so as to be during the second pushing member is moving backward when the number of sheets is less than a predetermined number of sheets, and sets the reactivation timing in the second folding control with pause so as to be during the second pushing member is moving forward when the number of sheets is equal to the predetermined number of sheets or greater.

Preferably, the control unit executes, instead of the second folding control with pause, a second folding control without pause to perform the second folding by conveying the sheet for a predetermined amount while maintaining rotation of the first roller, the second roller and the third roller started in the first folding control, pushing the sheet in the second nip by moving the second pushing member forward to the second nip while maintaining the rotation, and moving the second pushing member backward from the second nip.

Preferably, the sheet folding apparatus further includes a crease marking unit which performs crease marking at a folding position on the sheet before the first folding, and the control unit executes the second folding control with pause when the crease making is selected to be performed.

Preferably, the roller drive unit includes a stepping motor.

Preferably, the sheet folding apparatus further includes an encoder which outputs a signal corresponding to a position of the second pushing member to the second push drive unit, and on the basis of the signal output from the encoder, the control unit reactivates rotation of the first roller, the second roller and the third roller when the second pushing member is at a predetermined position in the second folding control with pause.

Preferably, the sheet folding apparatus further includes a detection unit which detects a conveyance direction tip position of the sheet which passed the first nip, and in the second folding control with pause, the control unit makes the detection unit detect the sheet while maintaining rotation of the first roller, the second roller and the third roller started in the first folding control, stops the rotation of the first roller, the second roller and the third roller in response to the detection signal, and makes the second pushing member move forward to the second nip.

Preferably, a moving speed of the second pushing member is faster than a conveyance speed of the sheet by the rotation of the first roller and the second roller, the sheet being nipped in the first nip.

Preferably, each of the first push drive unit and the second push drive unit includes a crank mechanism.

In order to realize at least one of the above objects, an image forming system reflecting another aspect of the present invention includes an image forming apparatus which forms an image on a sheet, and the sheet folding apparatus of claim 1 which performs the first folding and the second folding on the sheet on which the image is formed by the image forming apparatus, the sheet folding apparatus being connected to the image forming apparatus.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DESCRIPTION OF THE PREFERRED EMBODIMENTS

Hereinafter, the image forming system 1 which is an embodiment of the present invention will be described with reference to the drawings.

Figure 1:
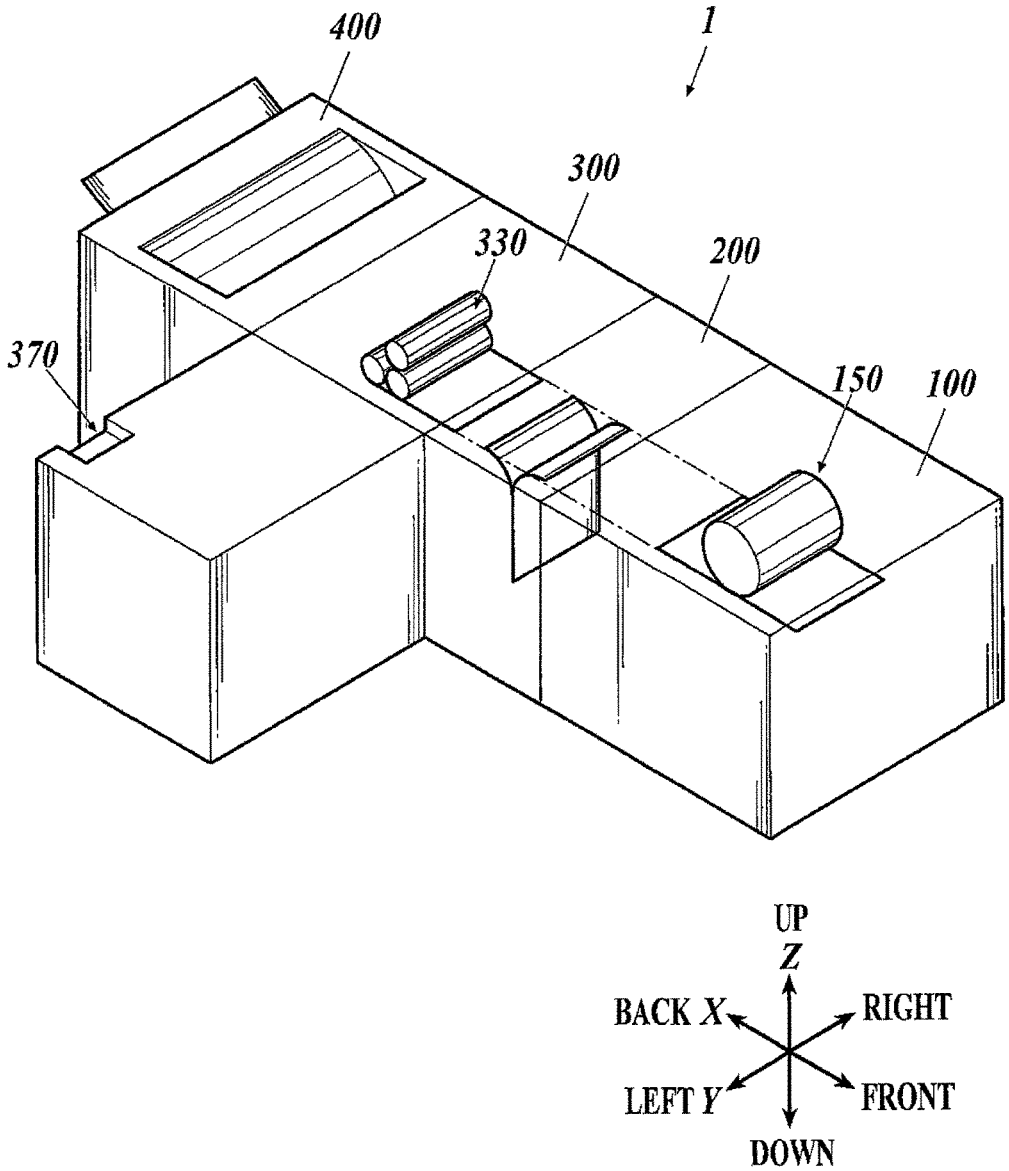
FIG. 1 is a schematic view showing an overall structure of an image forming system.

FIG. 1 is a schematic view of the overall structure of the image forming system 1.

As shown in FIG. 1, the image forming system 1 includes an image forming apparatus 100, an intermediate conveyance apparatus 200, a sheet processing apparatus 300 and a side stitching apparatus 400.

In the following description, the Z direction refers to the vertical direction, the X direction refers to the direction along which the image forming apparatus 100, the intermediate conveyance apparatus 200, the sheet processing apparatus 300 and the side stitching apparatus 400 are connected to each other as shown in FIG. 1, the Y direction refers to the direction orthogonal to the X direction and the Z direction.

The X direction is described in relation to the front side and the back side, and the Y direction is described in relation to the right side and the left side. Here, the front side refers to the upstream side in the conveyance direction of the image forming system 1, and the back side refers to the downstream side in the conveyance direction of the image forming system 1. The right side refers to the upstream side in the conveyance direction of the middle folding/saddle stitching in the sheet processing apparatus 300, and the left side refers to the downstream side in the conveyance direction of the middle folding/saddle stitching in the sheet processing apparatus 300.

The image forming apparatus 100 forms an image on a sheet.

In particular, the image forming apparatus 100 includes a conveyance unit which pulls out a sheet from sheets stacked in a paper tray as recording medium and conveys the sheets, a developing unit which develops a toner image according to bitmap data on a primary transfer member such as a transfer roller, a primary transfer unit which transfers the toner image which is developed on the primary transfer member to a secondary transfer member such as a transfer drum 150, a secondary transfer unit which transfers the toner image which is transferred on the secondary transfer member on a sheet which is conveyed by the conveyance unit, a fixing unit which fixes the transferred toner image on the sheet, a discharge unit which discharges the sheet on which fixing process is performed by the fixing unit, etc. The image forming apparatus 100 forms an image on a sheet.

Further, the image forming apparatus 100 forwards the discharged sheet on which an image is formed to the intermediate conveyance apparatus 200. That is, in the image forming system 1, the image forming apparatus 100 and the intermediate conveyance apparatus 200 are connected so that the sheets discharged from the image forming apparatus 100 are to be forwarded to the intermediate conveyance apparatus 200.

The intermediate conveyance apparatus 200 is an apparatus which makes a sheet be on standby temporarily, which can perform crease marking on a sheet and which trims a sheet.

In particular, the intermediate conveyance apparatus 200 includes a standby unit (stacker) which conveys a sheet which is conveyed from the image forming apparatus 100 by making it fall downward and which makes the sheet stop temporarily in a state where the surfaces thereof being along the Z direction, a matching unit which matches the position of the sheet which is on standby, a crease marking unit (creaser) which marks a crease on the matched sheet, a trimming unit (slitter) which trims margins of the sheet while conveying the sheet on which the crease marking is performed, etc.

That is, in the intermediate conveyance apparatus 200, the matching unit matches the sheet which is forwarded from the image forming apparatus 100 in a state where the sheet is stopped temporarily at the standby unit, the crease marking unit performs the crease marking on the sheet and thereafter, the trimming unit trims the margins of the sheet while conveying the sheet on which the crease marking is performed. Thereafter, the intermediate conveyance unit 200 forwards the sheet whose margins are trimmed by the trimming unit to the sheet processing apparatus 300.

Here, the intermediate conveyance apparatus 200 may forward the sheet which is forwarded from the image forming apparatus 100 to the sheet processing apparatus 300 without having a part of or all of various processes to be performed in the intermediate conveyance apparatus 200 performed thereon.

Figure 2:
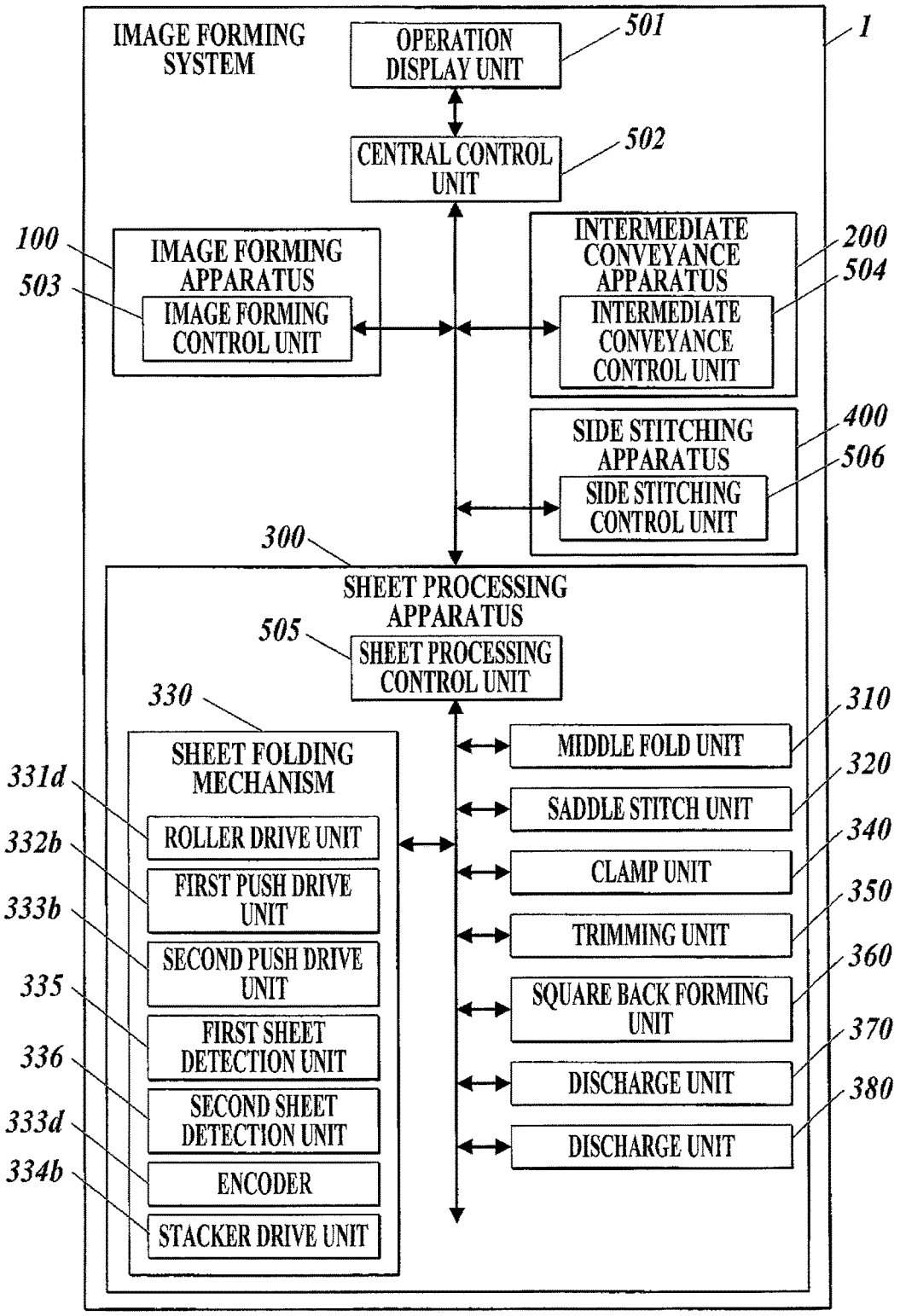
FIG. 2 is a block diagram showing a main structure with respect to operation control of the image forming system.

As shown in FIG. 2, the sheet processing apparatus 300 includes a sheet processing control unit 505 and a sheet folding mechanism 330 which performs the folding-in-three process.

The sheet folding mechanism 330 performs the folding-in-three process by sequentially carrying out the first folding at the first position and the second folding at the second position with respect to one sheet or a plurality of pages of sheets which are forwarded from the intermediate conveyance apparatus 200, the sheets are to be layered (bundled) in the case of a plurality of pages of sheets. The sheet processing control unit 505 performs controlling of operation relating to the folding-in-three process of the sheet folding mechanism 330, and the sheet folding apparatus is constituted of the sheet processing control unit 505 and the sheet folding mechanism 330.

As shown in FIG. 2, the sheet folding mechanism 330 includes a roller drive unit 331*d*, a first push drive unit 332*b*, a second push drive unit 333*b*, a first sheet detection unit 335, a second sheet detection unit 336, an encoder 333*d* and a stacker drive unit 334*b*.

Figure 3:
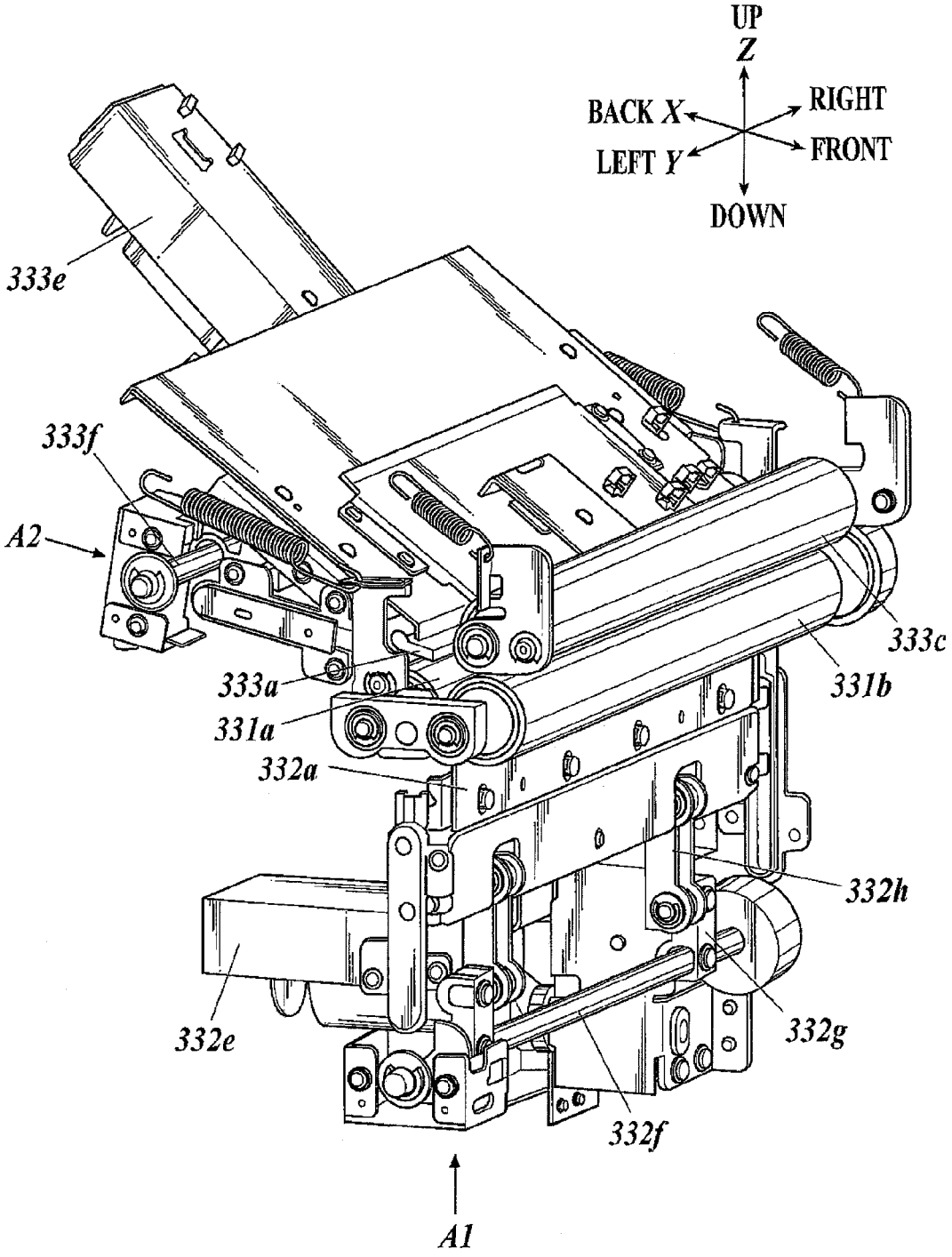
FIG. 3 is a schematic view of a sheet folding mechanism.
Figure 4:
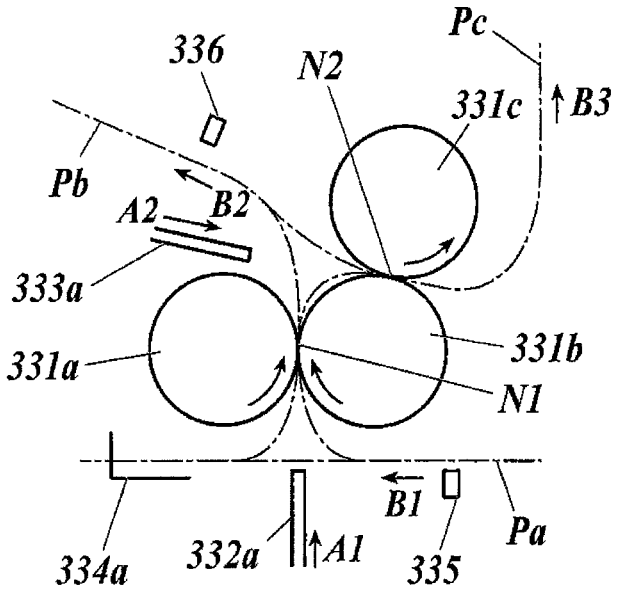
FIG. 4 is a schematic cross-sectional view of a main part of the sheet folding mechanism.

FIG. 3 is a schematic view of the sheet folding mechanism 330, and FIG. 4 is a schematic X-Z cross sectional view of a main part of the sheet folding mechanism 330.

The sheet folding mechanism 330 includes a first roller 331*a*, a second roller 331*b*, a third roller 331*c*, a first pushing member 332*a* and a second pushing member 333*a*. Each of the rollers 331*a*, 331*b* and 331*c* is made by its outer surface being covered with an elastic layer. The first roller 331*a* and the second roller 331*b* are pressed against each other by a pressure required to fold a sheet, and this configuration is a first nip N1 which performs the first folding. The second roller 331*b* and the third roller 331*c* are pressed against each other by a pressure required to fold a sheet, and this configuration is a second nip N2.

The roller drive unit 331*d* makes the rollers 331*a*, 331*b* and 331*c* rotate. The roller drive unit 331*d* is configured by including a stepping motor as its rotation power unit. For example, the roller drive unit 331*d* directly drives the roller 331*a*, and the rollers 331*a*, 331*b* and 331*c* rotates by the rollers 331*b* and 331*c* rotating following the rotation of the roller 331*a*. The roller which is to be directly driven by the roller drive unit 331*d* is not limited to the roller 331*a*, and may be any one of rollers 331*a*, 331*b* and 331*c*.

The first push drive unit 332*b* makes the first pushing member 332*a* reciprocate linearly, and the second push drive unit 333*b* makes the second pushing member 333*a* reciprocate linearly.

In particular, as shown in FIG. 3, the first push drive unit 332*b* includes a stepping motor 332*e*, a shaft 332*f*, a crank arm 332*g* and a link 332*h*. The stepping motor 332*e* rotationally drives the shaft 332*f*, and the crank arm 332*g* whose base end part is fixed to the shaft 332*f* rotates. The crank arm 332*g* is provided so as to extend in the radial direction of the shaft 332*f*, and its tip part is connected to one end of the link 332*h* so as to rotate freely. The other end of the link 332*h* is connected to the base end part of the first pushing member 332*a* so as to rotate freely. The first pushing member 332*a* is guided so as to move linearly in the direction of the arrow A1 toward the first nip N1. Turning of the shaft 332*f* is transmitted by the crank arm 332*g* and the link 332*h* and is converted into linear motion to make the first pushing member 332*a* reciprocate moving forward in the direction of the arrow A1 and return.

The second push drive unit 333*b* also includes a stepping motor 333*e* and a shaft 333*f* having a configuration similar to that of the first push drive unit 332*b*. However, their arrangement is different. The second pushing member 333*a* is configured so as to reciprocate moving in the direction of the arrow A2 toward the second nip N2 and return. An encoder 333*d* is provided with respect to the shaft 333*f* of the second push drive unit 333*b*, for example, and outputs a signal corresponding to the position of the second pushing member 333*a*.

Further, as shown in FIG. 4, the sheet folding mechanism 330 includes a stacker 334*a*.

The sheet folding mechanism 330 conveys a sheet which is forwarded from the intermediate conveyance apparatus 200 by a conveyance mechanism (not shown in the drawing) in the direction of the arrow B1 along the conveyance path Pa. The conveyance direction tip of the sheet which is conveyed in the direction of the arrow B1 along the conveyance path Pa is detected by the first sheet detection unit 335, and thereafter, the sheet stops due to its conveyance direction tip abutting the stacker 334*a*. In a case of folding a sheet bundle in three, a plurality of pages of sheets which constitute the sheet bundle are sequentially stacked, their ends are neatly matched by the stacker 334*a* and the sheets are held in the stacker 334*a*. The stacker 334*a* may be moved by the stacker drive unit 334*b* along the conveyance path Pa, and thereby, the folding position of a sheet can match the tip of the first pushing member 332*a*.

When the first pushing member 332*a* moves forward in the direction of the arrow A1 toward a sheet which is held by the stacker 334*a*, the first folding is performed by the sheet being pushed in the first nip N1.

The sheet which passed through the first nip N1 is conveyed in the direction of the arrow B2 along the conveyance path Pb by the first roller 331*a* and the second roller 331*b*, and the conveyance direction tip of the sheet is detected by the second sheet detection unit 336.

When the second pushing member 333*a* moves forward in the direction of the arrow A2 toward the sheet which is detected by the second sheet detection unit 336 and nipped by the first roller 331*a* and the second roller 331*b*, the second folding is performed by the sheet being pushed in the second nip N2. The sheet which is folded in three by passing through the second nip N2 is conveyed in the direction of the arrow B3 along the conveyance path Pc by the second roller 331*b*, the third roller 331*c* and a conveyance mechanism (not shown in the drawing) to be discharged.

The rotation directions of the rollers 331*a*, 331*b* and 331*c* in the folding-in-three process are as shown by the arc-shaped arrows in FIG. 4.

Further, as shown in FIG. 2, the sheet processing apparatus 300 includes a middle folding unit 310, a saddle stitch unit 320 which stacks (bundles) the sheets which are folded in the middle by the middle folding unit 310 and forms a saddle stitched booklet by stapling, a clamp unit 340 which holds the saddle stitched booklet by sandwiching the part near the folding line thereof, a trimming unit 350 which performs trimming of the fore edge of the saddle stitched booklet which is held by the clamp unit 340, a square back forming unit 360 which performs forming of the square back of the spine of the saddle stitched booklet, a discharge unit 370 which discharges the saddle stitched booklet outside, a discharge unit 380 which discharges the sheets which are folded in three by the sheet folding mechanism 330, etc.

Here, in the sheet processing apparatus 300, a sheet which is forwarded from the intermediate conveyance apparatus 200 can be forwarded to the side stitching apparatus 400 without having a part of or all of various processes to be performed in the sheet processing apparatus 300 performed thereof.

The side stitching apparatus 400 performs side stitching of a plurality of sheets.

In particular, the side stitching apparatus 400 includes a stapling unit which performs stapling of a plurality of sheets which are forwarded from the sheet processing apparatus 300, a page end trimming unit which performs fore edge trimming where the edges of the plurality of sheets which are parallel with the spine are partially trimmed in order to neatly match the edges of the plurality of sheets which are stapled, a discharge unit which discharges the sheets after being processed by various apparatuses which are connected, etc., for example.

Here, in the side stitching apparatus 400, a sheet which is forwarded from the sheet processing apparatus 300 can be discharged without having a part of or all of various processes to be processed in the side stitching apparatus 400 performed thereon.

Next, controlling of the image forming system 1 will be described more with reference to FIG. 2.

The image forming system 1 includes an operation display unit 501 which receives operations input by a user relating to the operation of the image forming system 1 and which performs a display output relating to the operation of the image forming system 1, a central control unit 502 which performs operational controlling of the entire image forming system 1, an image forming control unit 503 which performs operational controlling of the image forming apparatus 100, an intermediate conveyance control unit 504 which performs operational controlling of the intermediate conveyance apparatus 200, a sheet processing control unit (control unit) 505 which performs operational controlling of the sheet processing apparatus 300 and a side stitching control unit 506 which performs operational controlling of the side stitching apparatus 400.

The operation display unit 501 includes a touch panel type operation display device, switches and keys for various inputs, etc. The operation display unit 501 transmits a signal according to an input by a user to the central control unit 502.

Each of the central control unit 502, the image forming control unit 503, the intermediate conveyance control unit 504, the sheet processing control unit 505 and the side stitching control unit 506 includes a CPU, a RAM, a ROM, etc. and reads out a software program according to a process and various data to carry out a process.

The central control unit 502 sets various conditions in the image forming system 1 according to an input by a user which is input via the operation display unit 501.

These conditions include size of a sheet, the number of colors at the time of image forming (for example, color, gray scale, monochrome, etc.), control mode selection conditions in the folding-in-three process, the number of sheets to be folded in three, type, size and basis wait of a sheet to be folded in three, marking/not-marking a crease by a crease-marking unit (creaser) in the intermediate conveyance apparatus 200, width of an end section to be trimmed, etc., for example.

The central control unit 502 outputs a command to each control unit of the image forming control unit 503, the intermediate conveyance control unit 504, the sheet processing control unit 505 and the side stitching control unit 506 to perform a process according to a setting. Each control unit controls the operation of the apparatus which is subject to controlling according to the command.

For example, the central control unit 502 outputs a command for performing the folding-in-three process to the sheet processing control unit 505.

The sheet processing control unit 505 controls the sheet folding mechanism 330 and makes it perform the folding-in-three process according to the command.

Here, controlling of the folding-in-three process according to the embodiment will be described in detail.

The controlling is executed by the sheet processing control unit 505 according to the command for performing the folding-in-three process which is output from the central control unit 502. The sheet processing control unit 505 receives signals from the first sheet detection unit 335, the second sheet detection unit 336 and the encoder 333*d* and controls the roller drive unit 331*d*, the first push drive unit 332*b*, the second push drive unit 333*b* and the stacker drive unit 334*b* to execute the below described controlling.

Figure 5:
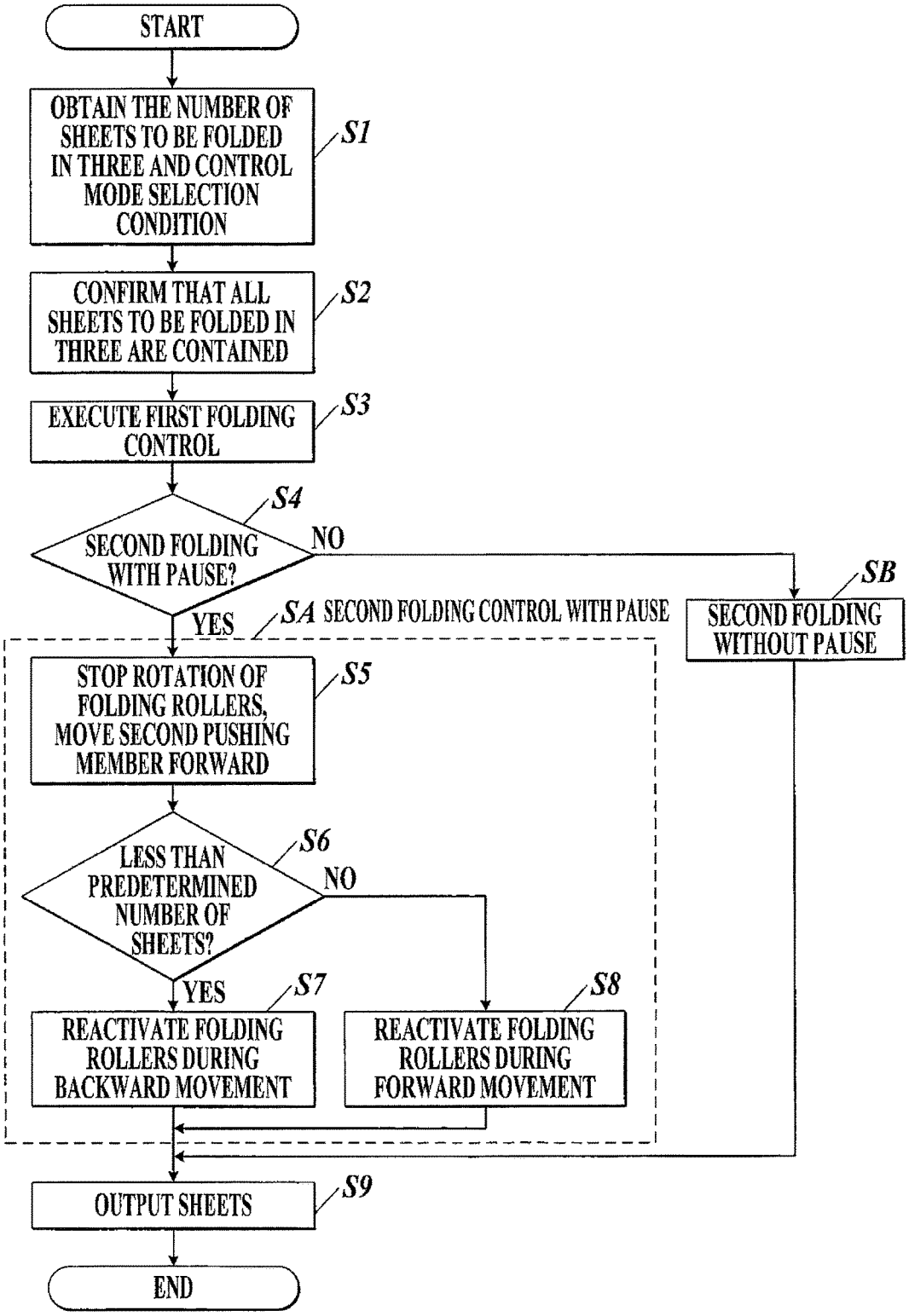
FIG. 5 is a flowchart showing controlling in a folding-in-three process.

FIG. 5 is a flowchart showing the controlling of the folding-in-three process. FIGS. 6A to 6F show schematic views of scenes showing work operations of the folding-in-three process.

The sheet processing control unit 505 includes a CPU, a RAM and a ROM. A program stored in the ROM is opened in the RAM and the CPU executes the program to realize the process shown in FIG. 5.

With reference to FIG. 5, first, the sheet processing control unit 505 obtains setting conditions such as the number of sheets to be folded in three and the control mode selection conditions relating to the command output from the central control unit 502 (step S1).

Figure 6A:
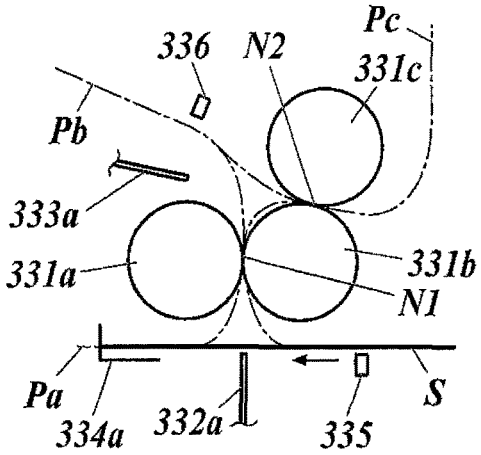
FIGS. 6A to 6F are schematic views showing scenes of operation in the folding-in-three process.

Next, the sheet processing control unit 505 conveys the sheet S which is forwarded from the intermediate conveyance apparatus 200 and confirms whether number of sheets corresponding to the above obtained number of sheets to be folded in three are all contained in the stacker 334*a* on the basis of the a signal from the first sheet detection unit 335 (step S2, FIG. 6A).

Figure 6B:
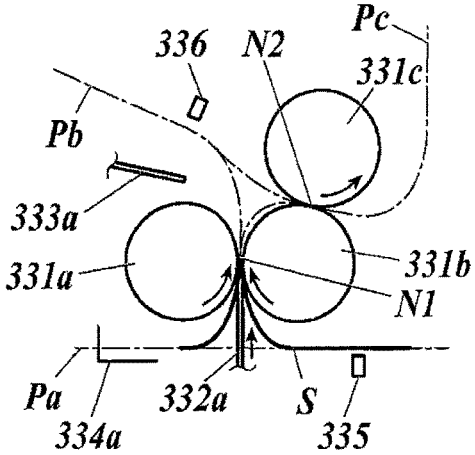
Figure 6C:
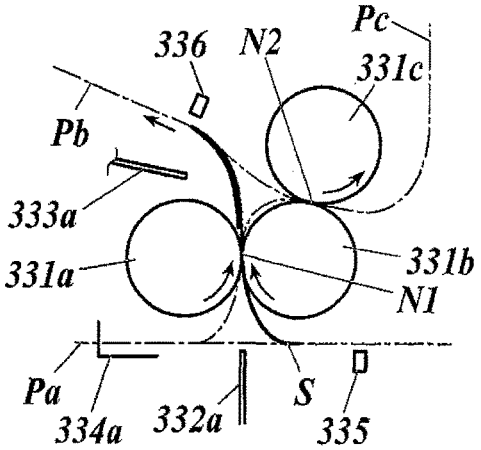

Next, the sheet processing control unit 505 executes the first folding control wherein the sheet folding mechanism 330 is made to perform the first folding (step S3). That is, the sheet processing control unit 505 makes the first, second and third rollers 331*a*, 331*b* and 331*c* rotate by this time, and while the rollers are rotating, makes the first pushing member 332*a* move forward to the first nip N1 to push the sheet S in the first nip N1 (FIG. 6B). In such way, the sheet S is pulled in the first nip N1 and the first folding is performed thereon. The sheet processing control unit 505 switches the first pushing member 332*a* to backward movement from frontward movement and makes the first pushing member 332*a* move backward to the first nip.

As described above, in the first folding control according to the embodiment, the first pushing member 332*a* is pushed in to the first nip N1 while the first, second and third rollers 331*a*, 331*b* and 331*c* are rotating. This is to accurately pull the sheet S in between the rollers 331*a* and 331*b* by pushing the sheet S in the first nip N1 while the rollers are rotating in a state where a downward force is applied by the gravity to the sheet S which is being conveyed (see FIG. 6A).

Next, the sheet processing control unit 505 refers to the obtained control mode selection conditions and determines whether the conditions of application of the second folding control with pause are met (step S4). The conditions of application of the second folding control with pause are not met when the setting indicates forced execution of the second folding control without pause, and the controlling flow branches to NO in step S4. The conditions of application of the second folding control with pause are met when the setting indicates forced execution of the second folding control with pause, and the controlling flow branches to YES in step S4. Further, with respect to the conditions of application of the second folding control with pause, when either of the forced execution is not set and when it is set to perform the second folding control with pause when a crease is marked by the crease marking unit (creaser) of the intermediate conveyance apparatus 200, whether crease marking is performed or not is determined. If crease marking is performed, the controlling flow branches to YES in step S4, and if crease marking is not performed, the controlling flow branches to NO in step S4. If crease marking is performed, mismatching of the marked crease and the folding position greatly affect the quality. Since accuracy in the folding position is expected, even when forced execution of the second folding control with pause is not set, the second folding control with pause is to be automatically selected when crease marking is performed.

Figure 6D:
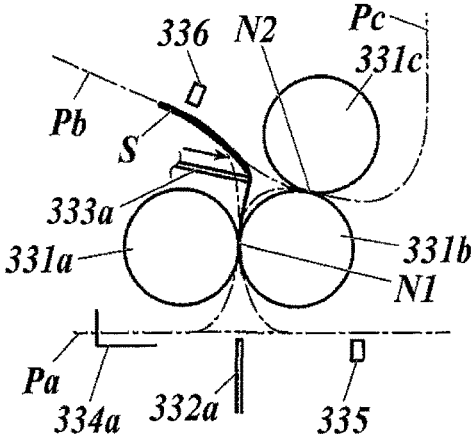

If the controlling flow branches to YES in step S4, the sheet processing control unit 505 maintains rotation of the first, second and third rollers 331*a*, 331*b* and 331*c* that started in the first folding control in step S3, makes the second sheet detection unit 336 detect the sheet S (FIG. 6C), stops rotation of the first, second and third rollers 331*a*, 331*b* and 331*c* in response to the detection signal and makes the second pushing member 333*a* move forward to the second nip N2 (step S5, FIG. 6D).

Here, the time period until the rollers 331*a*, 331*b* and 331*c* stop their rotation from when the detection signal is received from the second sheet detection unit 336 is set according to the second folding position that is specified in compliance with the command output from the central control unit 502. Stopping of the rotation in step S5 is performed in a state where the sheet S is nipped in the first nip N1.

Next, the sheet processing control unit 505 determines whether the number of sheets S to be folded in three is less than a predetermined number (step S6).

Regardless of the determination in step S6, the sheet processing control unit 505 makes the second pushing member 333*a* move forward to push the sheet S in the second nip N2 and switches the second pushing member 333*a* to backward movement from frontward movement so as to make it move back from the second nip N2. Here, the moving speed of the first pushing member 332*a* and the moving speed of the second pushing member 333*a* are set so as to be faster than the conveyance speed of the sheet S by the rotation of the rollers 331*a*, 331*b* and 331*c*.

Figure 6E:
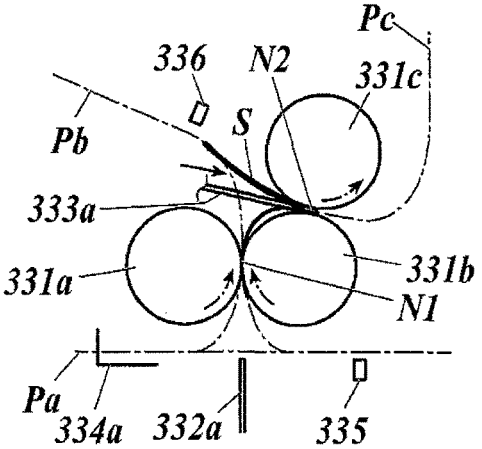

If the controlling flow branches to YES in step S6, the sheet processing control unit 505 reactivates rotation of the first, second and third rollers 331*a*, 331*b* and 331*c* while the second pushing unit 333*a* is moving backward (step S7). FIG. 6E shows where the tip of the second pushing member 333*a* is inserted in the second nip N2 and the second pushing member 333*a* is about to be switched to backward movement from frontward movement. From this point, the second pushing member 333*a* starts to move backward, and after the backward movement of the second pushing member 333*a* started, rotation of the rollers 331*a*, 331*b* and 331*c* is reactivated. The reactivation timing is preset according to the position of the second pushing member 333*a*. On the basis of a signal output from the encoder 333*d*, the sheet processing control unit 505 reactivates the rotation of the rollers 331*a*, 331*b* and 331*c* when the second pushing member 333*a* is at a predetermined position. Here, reactivation timing of the rotation of the rollers 331*a*, 331*b* and 331*c* can be controlled based on time with reference to the timing to start forward movement of the second pushing member 333*a* regardless of its position.

Figure 6F:
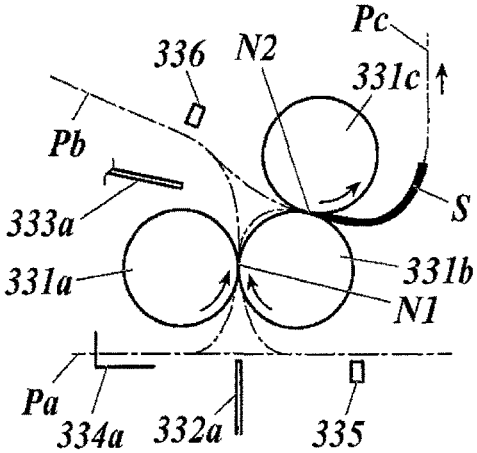

As described above, since the second pushing member 333*a* is moved forward as the rotation of the rollers 331*a*, 331*b* and 331*c* stops and the rollers 331*a*, 331*b* and 331*c* start rotating after the second pushing member 333*a* starts moving backward, the second folding is performed by the second pushing member 333*a* coming in contact with the sheet S and pushing the sheet S whose conveyance is stopped, pushing the sheet S in the second nip N2 by the second pushing member 333*a* in a state where the rollers 331*a*, 331*b* and 331*c* are stopped and pulling in the sheet S by the rollers 331*b* and 331*c* which started to rotate (FIG. 6F).

In such way, the tip of the second pushing member 333*a* can come in contact with the sheet S which is temporarily stopped and the sheet S can be pushed in to the second nip N2, thus, the second folding, which is folding at the second position, can be performed at more accurate position.

If the controlling flow branches to YES in step S6, the sheet processing control unit 505 reactivates the rotation of the first, second and third rollers 331*a*, 331*b* and 331*c* while the second pushing member 333*a* is moving forward (step S8). FIG. 6E shows a scene where the tip of the second pushing member 333*a* is inserted in the second nip N2 and the second pushing member 333*a* is about to be switched to backward movement from frontward movement. Before reaching this state, rotation of the rollers 331*a*, 331*b* and 331*c* is reactivated. The reactivation timing is preset based on the position of the second pushing member 333*a*, and on the basis of a signal output from the encoder 333*d*, the sheet processing control unit 505 reactivates the rotation of the rollers 331*a*, 331*b* and 331*c* when the second pushing member 333*a* is at a predetermined position. Here, reactivation timing of the rotation of the rollers 331*a*, 331*b* and 331*c* can be controlled based on time with reference to the timing to start forward movement of the second pushing member 333*a* regardless of its position.

Since the rollers 331*a*, 331*b* and 331*c* start to rotate while the second pushing member 333*a* is moving forward, the second folding is performed by the sheet S being pushed in the second nip N2 by the second pushing member 333*a* and pulled in by the rollers 331*b* and 331*c* in a state where the rollers 331*a*, 331*b* and 331*c* are rotating (FIG. 6F).

As in the control of step S7, if the second pushing member 333*a* starts to move backward in a state where the sheet S will not be pulled in the second nip N2 due to the rollers 331*b* and 331*c* being stopped, the greater the number of sheets S, the weaker the holding of all of the sheets S to be held in the second nip N2 by the pushing of the second pushing member 333*a*. Thus, there is a greater possibility that one or a plurality of sheets near the second pushing member 333*a* (inside sheets) will fall.

However, since the sheet S is pushed in to the second nip N2 by the second pushing member 333*a* in a state where the rollers 331*a*, 331*b* and 331*c* are rotating according to the control of step S8, the above problem can be prevented, and the second folding, which is folding at the second position, can be performed at more accurate position.

The position of the second pushing member 333*a* that decides the reactivation timing in step S8 is preferably at the position where the tip of the second pushing member 333*a* enters the second nip N2 side exceeding the conveyance path Pb. That is, it is preferred that the rollers 331*a*, 331*b* and 331*c* start to rotate after the second pushing member 333*a* starts to push the sheet S. Thereby, the second folding, which is folding at the second position, can be performed at more accurate position.

On the other hand, if the controlling flow branches to NO in step S4, the sheet processing control unit 505 executes the second folding control without pause where the second folding is performed by making the second detecting unit 336 detect the sheet S while maintaining the rotation of the first, second and three rollers 331*a*, 331*b* and 331*c* that started in the first folding control of step S3 (FIG. 6C), making the second pushing member 333*a* move forward to the second nip N2 to push the sheet S in the second nip N2 according to the detection signal, and then making the second pushing member 333*a* move backward from the second nip N2 (step SB). During this process, the rollers 331*a*, 331*b* and 331*c* do not stop rotating.

In such way, the second folding is performed by the sheet S being pushed in the second nip N2 by the second pushing member 333*a* and pulled in by the rollers 331*b* and 331*c* (FIG. 6F).

According to the second folding control without pause SB, the folding-in-three process can be performed with priority on shortening the process time comparing to the second folding control with pause (step SA in FIG. 5).

Thereafter, after any of the above described steps S7, S8 and SB, the sheet processing control unit 505 conveys the sheet S on which the second folding is performed and carries out its discharge process (step S9).

In addition to the controlling described with reference to FIGS. 5 and 6, the sheet processing control unit 505 may also control the first folding position by adjusting the position of the stacker 334*a* by controlling the stacker drive unit 334*b* according to the setting conditions relating to the command output by the central control unit 502 in step S2.

According to the embodiment, a user can select between the second folding control with pause SA and the second folding control without pause SB taking into consideration the speed and accuracy of the process according to the usage and the like of the documents to be folded in three.

If the second folding control with pause SA is selected, priority is given to the accuracy of the process. The accuracy of the position of the second folding is assured by changing the reactivation timing of the rollers 331*a*, 331*b* and 331*c* in the second folding control with pause SA according to the number of sheets to be folded in three.

The quality of sheets folded in three can be assured by a user selecting the second folding control with pause SA only when crease marking is to be performed on the sheet.

Despite the above embodiment, whether to implement the function to select between the second folding control with pause SA and the second folding control without pause SB according to marking or not marking a crease is optional. A function to select between the second folding control with pause SA and the second folding control without pause SB according to other conditions such as the sheet type, processing details, etc. in addition to marking or not marking a crease can be implemented.

Further, configuration may be such that only the second folding control with pause SA is to be applied with respect to the second folding and steps S4 and SB are eliminated (step S5 being the step after step S3).

Moreover, steps S6 and S8 may also be eliminated (step S7 being the step after step S5). In such case, a function to select so that the second folding control without pause SB is to be applied if the number of sheets is a predetermined number or greater can be implemented.

Further, steps S4, SB, S6 and S8 may be eliminated (step S5 being the step after step S3, step S7 being the step after step S5).

Furthermore, steps S6 and S7 may be eliminated (step S8 being the step after step S5).

Moreover, steps S4, SB, S6 and S7 may be eliminated (step S5 being the step after step S3, step S8 being the step after step S5).

Further, it is optional to fold a sheet four times or more by increasing the number of folding, performing more folding in addition to the first folding, the second adding.

The entire disclosure of Japanese Patent Application No. 2013-180846 filed on Sep. 2, 2013 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A sheet folding apparatus which performs a first folding and a second folding after the first folding on one sheet or a plurality of pages of sheets, the sheet folding apparatus comprising:

a first roller which is one of rollers that form a first nip which performs the first folding;

a second roller which, with the first roller, forms the first nip;

a third roller which, with the second roller, forms a second nip which performs the second folding;

a roller drive unit which operates the first roller, the second roller, and the third roller;

a first pushing member which pushes a sheet in the first nip;

a first push drive unit which operates the first pushing member;

a second pushing member which pushes the sheet in the second nip;

a second push drive unit which operates the second pushing member; and a control unit which controls the roller drive unit, the first push drive unit, and the second push drive unit, wherein the control unit executes:

a first folding control to perform the first folding by pushing the sheet in the first nip by moving the first pushing member forward to the first nip and moving the first pushing member backward from the first nip in a state where the first roller, the second roller, and the third roller are rotating; and a second folding control with pause to perform the second folding by conveying the sheet for a predetermined amount while maintaining rotation of the first roller, the second roller, and the third roller started in the first folding control, then, stopping the rotation of the first roller, the second roller, and the third roller and pushing the sheet in the second nip by moving the second pushing member forward to the second nip, and thereafter, moving the second pushing member backward from the second nip and reactivating the rotation of the first roller, the second roller, and the third roller at a certain reactivation timing between a start of the forward movement of the second pushing member and an end of the backward movement of the second pushing member.

2. The sheet folding apparatus of claim 1, wherein the control unit changes the reactivation timing in the second folding control with pause according to a number of sheets.

3. The sheet folding apparatus of claim 1, wherein the control unit:

sets the reactivation timing in the second folding control with pause so as to be during when the second pushing member is moving backward when the number of sheets is less than a predetermined number of sheets, and sets the reactivation timing in the second folding control with pause so as to be during when the second pushing member is moving forward when the number of sheets is equal to or greater than the predetermined number of sheets.

4. The sheet folding apparatus of claim 1, further comprising a crease marking unit which performs crease marking at a folding position on the sheet before the first folding, wherein the control unit executes the second folding control with pause when the crease marking is selected to be performed.

5. The sheet folding apparatus of claim 1, wherein the roller drive unit includes a stepping motor.

6. The sheet folding apparatus of claim 1, further comprising an encoder which outputs a signal corresponding to a position of the second pushing member to the second push drive unit, wherein, based on the signal output from the encoder, the control unit reactivates the rotation of the first roller, the second roller, and the third roller when the second pushing member is at a predetermined position in the second folding control with pause.

7. The sheet folding apparatus of claim 1, further comprising a detection unit which detects a conveyance direction tip position of the sheet which passed the first nip, wherein in the second folding control with pause, the control unit controls the detection unit to detect the sheet while maintaining the rotation of the first roller, the second roller, and the third roller started in the first folding control, stops the rotation of the first roller, the second roller, and the third roller in response to the detection signal, and controls the second pushing member to move forward to the second nip.

8. The sheet folding apparatus of claim 1, wherein a moving speed of the second pushing member is faster than a conveyance speed of the sheet by the rotation of the first roller and the second roller, the sheet being nipped in the first nip.

9. The sheet folding apparatus of claim 1, wherein each of the first push drive unit and the second push drive unit includes a crank mechanism.

10. An image forming system, comprising:

an image forming apparatus which forms an image on a sheet; and the sheet folding apparatus of claim 1 which performs the first folding and the second folding on the sheet on which the image is formed by the image forming apparatus, the sheet folding apparatus being connected to the image forming apparatus.

11. A sheet folding apparatus which performs a first folding and a second folding after the first folding on one sheet or a plurality of pages of sheets, the sheet folding apparatus comprising:

a first roller which is one of rollers that form a first nip which performs the first folding;

a second roller which, with the first roller, forms the first nip;

a third roller which, with the second roller, forms a second nip which performs the second folding;

a roller drive unit which operates the first roller, the second roller, and the third roller;

a first pushing member which pushes a sheet in the first nip;

a first push drive unit which operates the first pushing member;

a second pushing member which pushes the sheet in the second nip;

a second push drive unit which operates the second pushing member; and a control unit which controls the roller drive unit, the first push drive unit, and the second push drive unit, wherein the control unit executes:

a first folding control to perform the first folding by pushing the sheet in the first nip by moving the first pushing member forward to the first nip and moving the first pushing member backward from the first nip in a state where the first roller, the second roller, and the third roller are rotating; and a second folding control to perform the second folding with pause or without pause based on whether or not a condition to perform the second folding with pause is met, wherein the second folding is performed with pause by conveying the sheet for a predetermined amount while maintaining rotation of the first roller, the second roller, and the third roller started in the first folding control, then, stopping the rotation of the first roller, the second roller, and the third roller and pushing the sheet in the second nip by moving the second pushing member forward to the second nip, and thereafter, moving the second pushing member backward from the second nip and reactivating the rotation of the first roller, the second roller, and the third roller at a certain reactivation timing between a start of the forward movement of the second pushing member and an end of the backward movement of the second pushing member, and wherein the second folding is performed without pause by conveying the sheet for the predetermined amount while maintaining the rotation of the first roller, the second roller, and the third roller started in the first folding control, pushing the sheet in the second nip by moving the second pushing member forward to the second nip while maintaining the rotation, and moving the second pushing member backward from the second nip.

12. A sheet folding apparatus which performs a first folding and a second folding after the first folding on one sheet or a plurality of pages of sheets, the sheet folding apparatus comprising:

a first roller which is one of rollers that form a first nip which performs the first folding;

a second roller which, with the first roller, forms the first nip;

a third roller which, with the second roller, forms a second nip which performs the second folding;

a roller drive unit which operates the first roller, the second roller, and the third roller;

a first pushing member which pushes a sheet in the first nip;

a first push drive unit which operates the first pushing member;

a second pushing member which pushes the sheet in the second nip;

a second push drive unit which operates the second pushing member; and a control unit which controls the roller drive unit, the first push drive unit, and the second push drive unit, wherein the control unit executes:

a first folding control to perform the first folding by pushing the sheet in the first nip by moving the first pushing member forward to the first nip and moving the first pushing member backward from the first nip in a state where the first roller and the second roller are rotating; and a second folding control with pause to perform the second folding by conveying the sheet for a predetermined amount while maintaining rotation of the first roller and the second roller started in the first folding control, then, stopping the rotation of the first roller and the second roller and pushing the sheet in the second nip by moving the second pushing member forward to the second nip, and thereafter, moving the second pushing member backward from the second nip and reactivating rotation of the second roller and the third roller at a certain reactivation timing between a start of the forward movement of the second pushing member and an end of the backward movement of the second pushing member.

13. The sheet folding apparatus of claim 12, wherein the control unit:

sets the reactivation timing in the second folding control with pause so as to be during when the second pushing member is moving backward when a number of sheets is less than a predetermined number of sheets, and sets the reactivation timing in the second folding control with pause so as to be during when the second pushing member is moving forward when the number of sheets is equal to or greater than the predetermined number of sheets.

14. The sheet folding apparatus of claim 12, further comprising a crease marking unit which performs crease marking at a folding position on the sheet before the first folding, wherein the control unit executes the second folding control with pause when the crease marking is selected to be performed.

15. An image forming system, comprising:

an image forming apparatus which forms an image on a sheet; and the sheet folding apparatus of claim 12 which performs the first folding and the second folding on the sheet on which the image is formed by the image forming apparatus, the sheet folding apparatus being connected to the image forming apparatus.

16. A sheet folding apparatus which performs a first folding and a second folding after the first folding on one sheet or a plurality of pages of sheets, the sheet folding apparatus comprising:

a first roller which is one of rollers that form a first nip which performs the first folding;

a second roller which, with the first roller, forms the first nip;

a third roller which, with the second roller, forms a second nip which performs the second folding;

a roller drive unit which operates the first roller, the second roller, and the third roller;

a first pushing member which pushes a sheet in the first nip;

a first push drive unit which operates the first pushing member;

a second pushing member which pushes the sheet in the second nip;

a second push drive unit which operates the second pushing member; and a control unit which controls the roller drive unit, the first push drive unit, and the second push drive unit, wherein the control unit executes:

a first folding control to perform the first folding by pushing the sheet in the first nip by moving the first pushing member forward to the first nip and moving the first pushing member backward from the first nip in a state where the first roller and the second roller are rotating; and a second folding control to perform the second folding with pause or without pause based on whether or not a condition to perform the second folding with pause is met, wherein the second folding is performed with pause by conveying the sheet for a predetermined amount while maintaining rotation of the first roller and the second roller started in the first folding control, then, stopping the rotation of the first roller and the second roller and pushing the sheet in the second nip by moving the second pushing member forward to the second nip, and thereafter, moving the second pushing member backward from the second nip and reactivating rotation of the second roller and the third roller at a certain reactivation timing between a start of the forward movement of the second pushing member and an end of the backward movement of the second pushing member, and wherein the second folding is performed without pause by conveying the sheet for the predetermined amount while maintaining the rotation of the first roller and the second roller started in the first folding control, pushing the sheet in the second nip by moving the second pushing member forward to the second nip while maintaining the rotation, and moving the second pushing member backward from the second nip.

* * * * *